US008006512B2

(12) United States Patent
Sanagi et al.

(10) Patent No.: US 8,006,512 B2
(45) Date of Patent: Aug. 30, 2011

(54) AIR CONDITIONER

(75) Inventors: Tsunehisa Sanagi, Sakai (JP); Azumi Terakawa, Sakai (JP); Akihiko Sakashita, Sakai (JP)

(73) Assignee: Daikin Industries, Ltd., Osaka (JP)

( * ) Notice: Subject to any disclaimer, the term of this patent is extended or adjusted under 35 U.S.C. 154(b) by 406 days.

(21) Appl. No.: 10/554,858

(22) PCT Filed: Nov. 18, 2004

(86) PCT No.: PCT/JP2004/017165
§ 371 (c)(1),
(2), (4) Date: Oct. 28, 2005

(87) PCT Pub. No.: WO2005/052465
PCT Pub. Date: Jun. 9, 2005

(65) Prior Publication Data

US 2006/0276123 A1 Dec. 7, 2006

(30) Foreign Application Priority Data

Nov. 27, 2003 (JP) ..... 2003-396521

(51) Int. Cl.
*F25D 17/06* (2006.01)

(52) U.S. Cl. ..... 62/426; 454/292

(58) Field of Classification Search ..... 62/259.1, 62/426, DIG. 16, 331, 262, 263, 298, 407, 62/419, 344, 353; 165/53; 454/233, 292, 454/299; 40/725, 720, 722, 723, 733
See application file for complete search history.

(56) References Cited

U.S. PATENT DOCUMENTS

| | | | | |
|---|---|---|---|---|
| 4,686,892 | A * | 8/1987 | Foster | 454/313 |
| 6,079,219 | A * | 6/2000 | Katsuki | 62/180 |
| 6,260,375 | B1 * | 7/2001 | Kuo | 62/407 |
| 6,282,912 | B1 * | 9/2001 | Mannerheim | 62/244 |
| 6,345,667 | B1 * | 2/2002 | Hata et al. | 165/200 |
| 6,470,699 | B1 * | 10/2002 | Okuda et al. | 62/259.2 |
| 6,554,059 | B2 * | 4/2003 | Hata et al. | 165/53 |
| 6,698,220 | B2 * | 3/2004 | Yoneno et al. | 62/184 |
| 6,780,097 | B2 * | 8/2004 | Shuttleworth et al. | 454/136 |
| 6,802,361 | B2 * | 10/2004 | Hatanaka | 165/53 |
| 7,066,712 | B2 * | 6/2006 | Kim et al. | 415/58.4 |

FOREIGN PATENT DOCUMENTS

| | | | |
|---|---|---|---|
| EP | 1152193 | A1 | 11/2001 |
| JP | H04-110312 | | 9/1992 |
| JP | H04-254121 | | 9/1992 |
| JP | H11-083060 | A | 3/1999 |
| JP | 2000-310443 | A | 11/2000 |
| JP | 2001-116281 | | 4/2001 |
| JP | 2001-336783 | | 7/2001 |
| JP | 4-64041 | | 6/2002 |

OTHER PUBLICATIONS

Translation of JP 2001-336783 A to Iemura.*

* cited by examiner

*Primary Examiner* — Mohammad Ali
(74) *Attorney, Agent, or Firm* — Global IP Counselors

(57) ABSTRACT

A ceiling embedded type air conditioner that reduces short circuits without increasing drafts due to air currents blown out from outlets includes a casing and a fan. The casing includes a casing lower part formed by an alternating sequence of four panel side parts and four panel corner parts. The casing further includes four main outlet passageways along the panel side parts, auxiliary outlet passageways in the three panel corner parts and an inlet that is surrounded by all of the panel side parts. The auxiliary outlet passageways are formed so that the spacing between each auxiliary outlet passageways and a corresponding adjacent main outlet passageways satisfies a prescribed dimensional relationship.

17 Claims, 10 Drawing Sheets

AIR CONDITIONER

CROSS-REFERENCE TO RELATED APPLICATIONS

This U.S. national stage application claims priority under 35 U.S.C. §119(a) to Japanese Patent Application No. 2003-396521, filed in Japan on Nov. 27, 2003 the entire contents of which are hereby incorporated by reference.

FIELD OF THE INVENTION

The present invention relates to an air conditioner, and more particularly relates to an air conditioner installed so that it is embedded in the ceiling of an air conditioned room.

RELATED ART

A so-called conventional ceiling embedded type air conditioner installed so that it is embedded in the ceiling of an air conditioned room principally comprises: a casing having a casing lower part formed by an alternating sequence of a plurality of side parts and a plurality of corner parts; outlets disposed so that each runs along a side part and an inlet disposed so that it is surrounded by the side parts; and a fan and a heat exchanger disposed inside the casing.

Furthermore, when this type of an air conditioner operates, the air inside the air conditioned room flows from the space below the inlet toward the inlet and is sucked inside the casing through the inlet. Then, the heat of the air sucked into the casing is exchanged by the heat exchanger, and is subsequently blown out through the outlets from the vicinity of the ceiling of the air conditioned room downward and diagonally into the air conditioned room. Here, the majority of the air currents blown out from inside the casing through the outlets reaches a far-off distance from the air conditioner, but a portion of the air currents blown out from inside the casing through the outlets is sucked into the inlet immediately after being blown out. Such a phenomenon is referred to as a short circuit, and the performance of the air conditioner drops if this short circuit increases (namely, if there is an increase in the flow volume of the air sucked into the inlet immediately after being blown out from inside the casing through the outlets).

In contrast, it is known to reduce short circuits by providing a plurality of outlets inside the casing except at the portions where both end parts of the heat exchanger are disposed, and by ensuring passageways wherein air flows from the outer circumferential side of the inlet toward the inlet—not only in the space below the inlet, but also in the portions where the outlets are not provided (for example, see Japanese Published Patent Application No. 2001-116281).

However, although it is possible with such an air conditioner to ensure passageways at the portions where outlets are not provided and wherein air flows from the outer circumferential side of the inlet toward the inlet, short circuits occur outside of these portions at the portions between the outlets, and it is therefore preferable to further reduce short circuits at such portions. In contrast, it is conceivable to reduce the number of outlets by increasing the space between the outlets, reducing the opening area of the outlets, and the like; however, doing so will increase the flow speed of the air currents blown out from the outlets, thereby increasing drafts.

SUMMARY OF THE INVENTION

It is an object of the present invention to reduce short circuits in a ceiling embedded type air conditioner, without increasing drafts due to air currents blown out from outlets.

An air conditioner according to a first aspect of the present invention is an air conditioner installed embedded in the ceiling of an air conditioned room, comprising a casing and a fan. The casing comprises: a casing lower part formed by an alternating sequence of a plurality of side parts and a plurality of corner parts; side part outlets disposed along each of the side parts; corner part outlets disposed at at least one of the plurality of corner parts; and an inlet disposed so that it is surrounded by all of the side parts. The fan, disposed inside the casing, sucks in air from the inlet into the casing, and blows out the sucked in air from the side part outlets and the corner part outlets into the air conditioned room. The dimensional relationship between each corner part outlet and the side part outlets adjacent to that corner part outlet is:

$$D/(L_1W_1+S_2)^{0.5}>0.15$$

where D is the distance between a first proximate part, which is the most proximate part of each corner part outlet to each side part outlet, and a second proximate part, which is the most proximate part of each side part outlet to each corner part outlet, $L_1$ is the length of each side part outlet in the direction along an outer circumferential edge of the side part, $W_1$ is the width of each side part outlet in the direction orthogonal to the outer circumferential edge of the side part, and $S_2$ is the opening area of each corner part outlet.

To prevent an increase in drafts due to the formation of a corner part outlet at each corner part between side part outlets in a ceiling embedded type air conditioner disposed so that the side part outlets surround the inlet, the present inventor(s) conducted research on the spacing between each corner part outlet and the side part outlets adjacent to that corner part outlet with the capability so that the air currents blown out toward the inside of the air conditioned room from the corner part outlets and the side part outlets from the portions between each corner part outlet and the side part outlets adjacent to that corner part outlet do not short circuit to the inlet, i.e., a spacing at the portions between each corner part outlet and the side part outlets adjacent to that corner part outlet capable of ensuring passageways for the air sucked into the inlet from the outer circumferential side of the inlet.

As a result, a dimensional relationship formula for the abovementioned spacing between each corner part outlet and the side part outlets adjacent to that corner part outlet was identified. This relationship formula can determine the minimum spacing, in accordance with the opening size of the side part outlets and the corner part outlets, that can reduce short circuits.

Thereby, with this air conditioner, the corner part outlets can be disposed with an appropriate spacing in accordance with the opening size of the side part outlets adjacent to those corner part outlets; consequently, it is possible to ensure passageways for the air sucked into the inlet from the outer circumferential side of the inlet, even at the portions between each corner part outlet and the side part outlets adjacent to that corner part outlet. Thereby, short circuits can be reduced without increasing drafts.

An air conditioner according to a second aspect of the present invention is an air conditioner as recited in the first aspect of the present invention, wherein the opening area of each corner part outlet is less than the opening area of each side part outlet.

With this air conditioner, the flow speed of the air blown out from each side part outlet does not decrease significantly, and the air current blown out from each side part outlet can consequently reach as far as possible. Moreover, because the flow speed of the air blown out from each corner part outlet is low, and a difference is created in the reach between the air current blown out from each corner part outlet and the air current blown out from each side part outlet, it is possible to ensure passageways, below the air current blown out from each corner part outlet, for the air sucked into the inlet.

An air conditioner according to a third aspect of the present invention is an air conditioner as recited in the first aspect of the present invention or the second aspect of the present invention, wherein the two side part outlets adjacent to both sides of each of the corner part outlets are disposed so that they are substantially mutually orthogonal.

With this air conditioner, it is possible to dispose the side part outlets and the corner part outlets with an appropriate spacing in accordance with their opening sizes for the case wherein the casing lower part, in a plan view, is substantially rectangular or square shaped; consequently, it is also possible to ensure passageways, between mutually adjacent side part outlets and corner part outlets, for the air sucked into the inlet. Thereby, short circuits can be reduced without increasing drafts.

An air conditioner according to a fourth aspect of the present invention is an air conditioner as recited in any one of the first through third aspects of the present invention, wherein circumferential edge parts of each corner part outlet are formed so that an air current blown out from each corner part outlet is blown out in a direction away from an air current blown out from each of the adjacent two side part outlets. corner part outlet is blown out in a direction away from an air current blown out from each of the adjacent two side part outlets.

With this air conditioner, it is even easier to ensure passageways, between each corner part outlet and the side part outlets adjacent to that corner part outlet, for the air sucked into the inlet.

An air conditioner according to a fifth aspect of the present invention is an air conditioner as recited in any one of the first through third aspects of the present invention, wherein each corner part outlet is provided with a guide flap that guides the air current blown out from each corner part outlet so that it blows out away from the air current blown out from each of the adjacent two side part outlets.

With this air conditioner, it is even easier to ensure passageways, between each corner part outlet and the side part outlets adjacent to that corner part outlet, for the air sucked into the inlet.

DETAILED DESCRIPTION OF THE PREFERRED EMBODIMENTS

The following explains the embodiments of an air conditioner according to the present invention, referencing the drawings.

(1) Basic Constitution of the Air Conditioner

Figure 1:
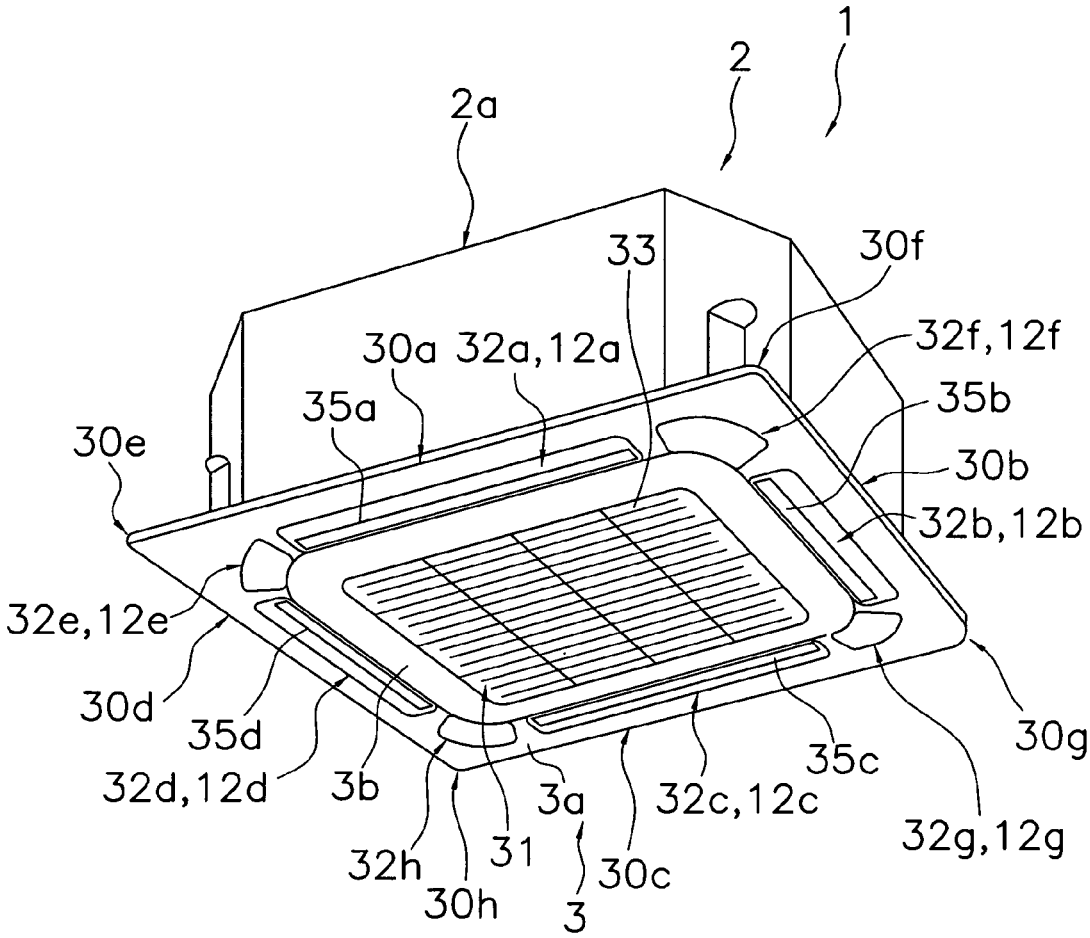
FIG. 1 is an external perspective view of an air conditioner according to one embodiment of the present invention.
Figure 2:
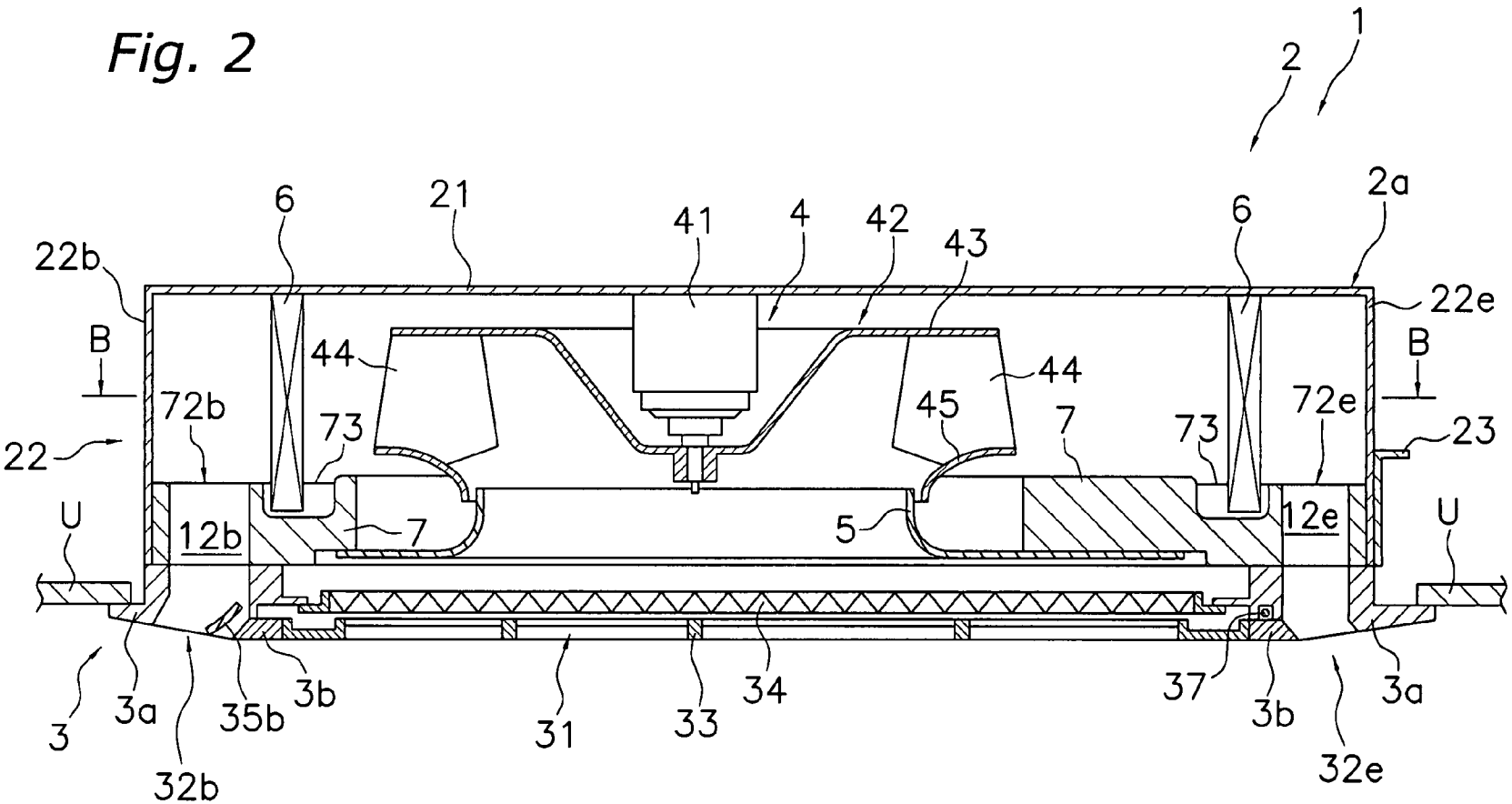
FIG. 2 is a schematic side cross sectional view of the air conditioner, and is a cross sectional view taken along the A-O-A line in FIG. 3.

FIG. 1 is an external perspective view of an air conditioner 1 according to one embodiment of the present invention (ceiling is not shown). The air conditioner 1 is a ceiling embedded type air conditioner, and comprises a casing 2 that internally houses various constituent equipment. The casing 2 comprises a casing main body 2*a*, and a face panel 3 disposed on the lower side of the casing main body 2*a*. As shown in FIG. 2, the casing main body 2*a* is disposed inserted into an opening formed in a ceiling U of the air conditioned room. Furthermore, the face panel 3 is disposed so that it is fitted into the opening of the ceiling U. Here, FIG. 2 is a schematic side cross sectional view of the air conditioner 1, and is a cross sectional view taken along the A-O-A line in FIG. 3.

<Casing Main Body>

Figure 3:
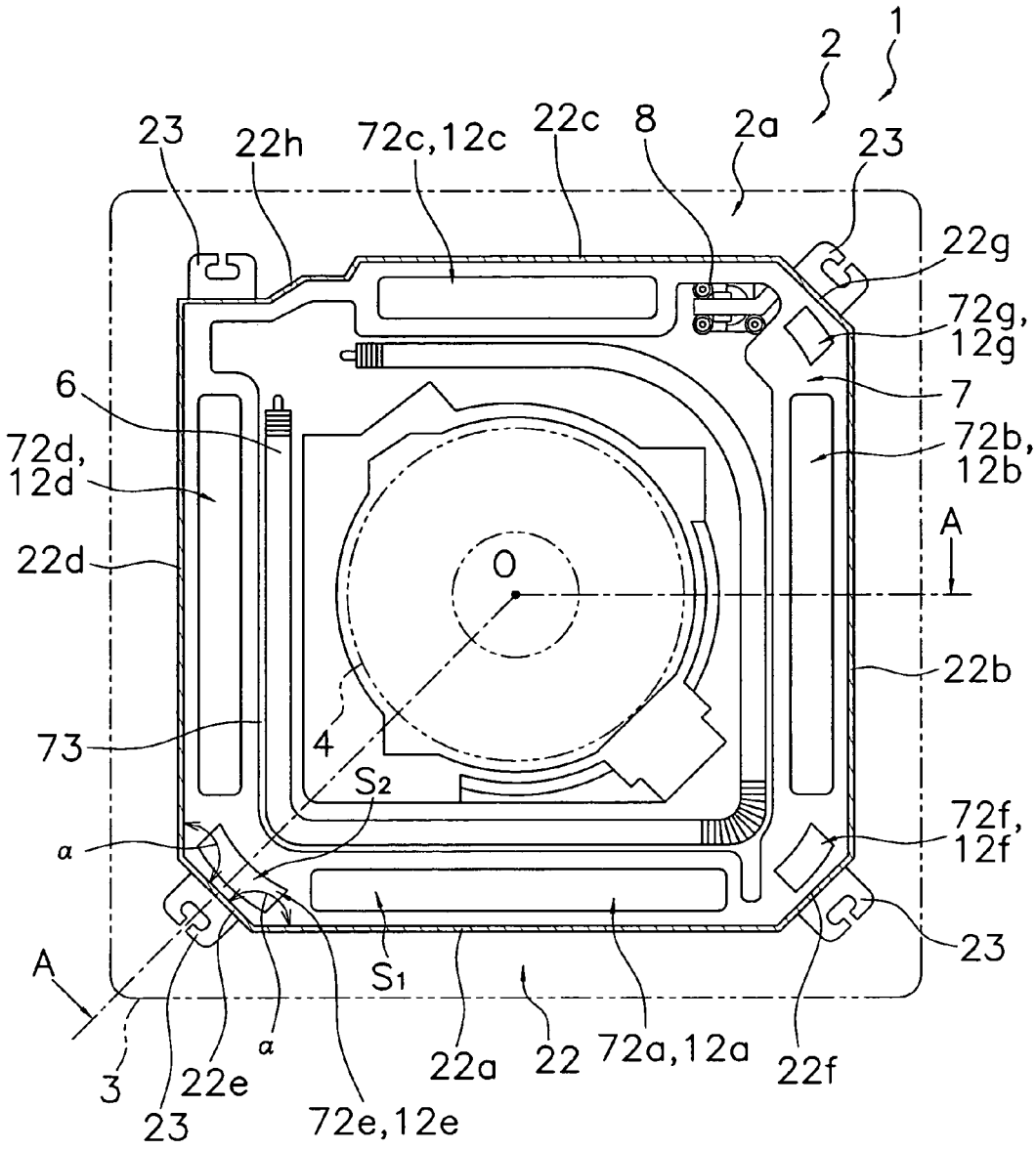
FIG. 3 is a schematic plan cross sectional view of the air conditioner, and is a cross sectional view taken along the B-B line in FIG. 2.

As shown in FIG. 2 and FIG. 3, the casing main body 2*a* is, in a plan view thereof, a box shaped body whose substantially octagonal lower surface is open and formed by alternating long sides and short sides, and comprising: a substantially octagonal top plate 21 formed by an alternating sequence of long sides and short sides; and a side plate 22 extending downward from a circumferential edge part of the top plate 21. Here, FIG. 3 is a schematic plan cross sectional view of the air conditioner 1, and is a cross sectional view taken along the B-B line in FIG. 2.

The side plate 22 comprises side plates 22*a*, 22*b*, 22*c*, 22*d* corresponding to the long sides of the top plate 21, and side plates 22*e*, 22*f*, 22*g*, 22*h* corresponding to the short sides of the top plate 21. Here, for example, the side plate 22*d* and the side plate 22*a* are disposed so that they are mutually substantially orthogonal with the side plate 22*e* interposed therebetween. The other side plates 22*a*, 22*b*, side plates 22*b*, 22*c*, and side plates 22*c*, 22*d* are likewise disposed so that they are mutually substantially orthogonal, the same as the side plates 22*d*, 22*a*. In addition, the side plate 22*e* is disposed so that an angle a formed between the adjoining side plate 22*d* and side plate 22*a* is approximately 135°. The side plates 22*f*, 22*g* are also disposed so that the angle formed between the adjoining side plates is approximately 135°, the same as the side plate 22*e*. Furthermore, the side plate 22*h* is shaped differently than the other side plates 22*e*, 22*f*, 22*g*, and comprises a portion wherethrough passes a refrigerant piping for exchanging refrigerants between a heat exchanger 6 (discussed later) and an outdoor unit (not shown). In addition, each of the side plates 22*e*, 22*f*, 22*g*, 22*h* is provided with a fixing bracket 23 used when installing the casing main body 2*a* in the space above the ceiling. Further, the lengths of the long sides and the short sides of the top plate 21 are set so that, in a plan view, the shape of the casing main body 2*a* including the fixing brackets 23 becomes substantially quadrilateral.

<Face Panel>

Figure 4:
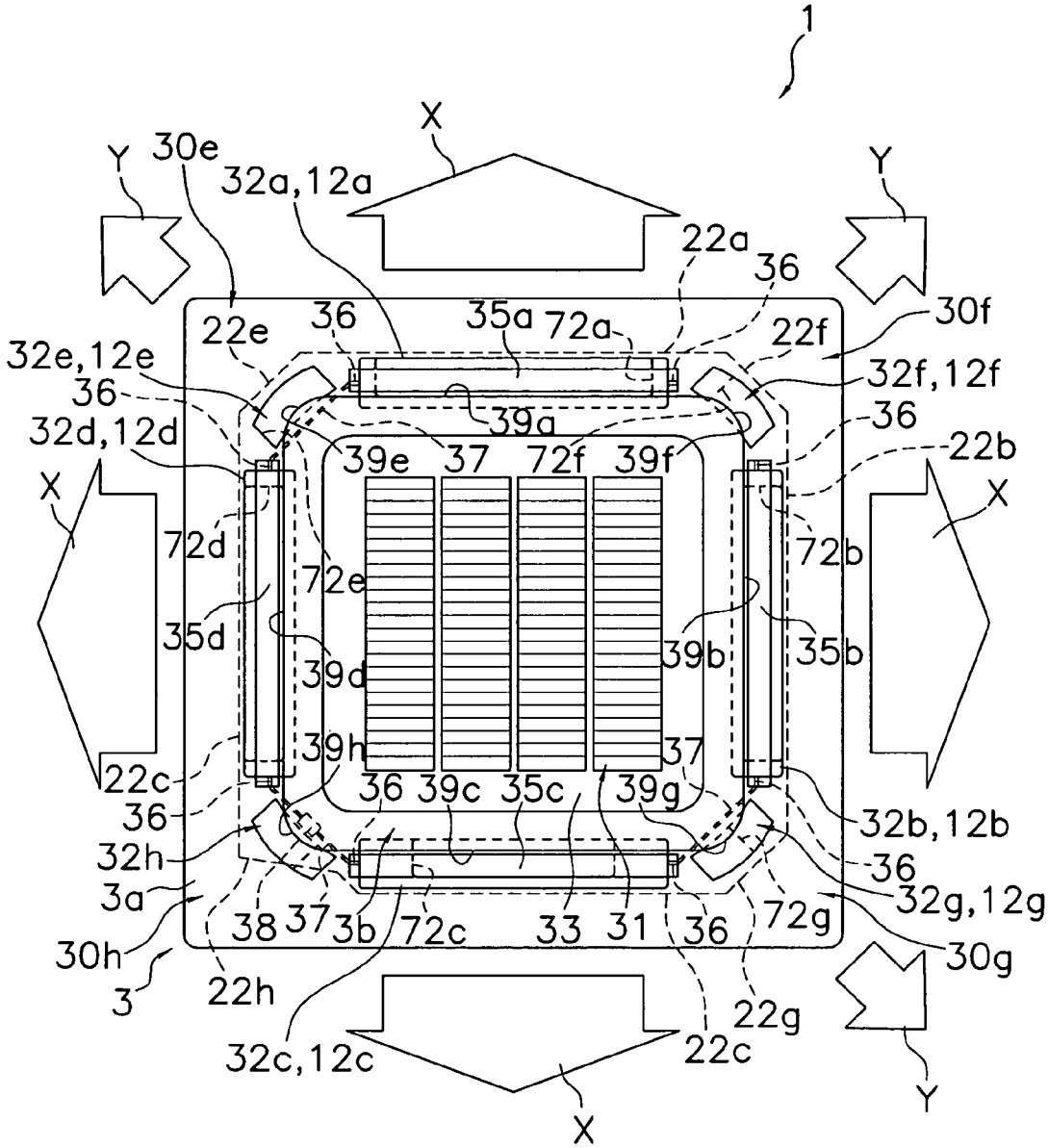
FIG. 4 is a plan view of a face panel of the air conditioner, viewed from inside the air conditioned room.

The face panel 3 is a substantially quadrilateral plate shaped body, in a plan view, as shown in FIG. 2, FIG. 3, and FIG. 4, and principally comprises a panel main body 3*a* fixed to a lower end part of the casing main body 2*a*. Here, FIG. 4 is a plan view of the face panel 3 of the air conditioner 1, viewed from inside the air conditioned room.

The panel main body 3*a* is formed by an alternating sequence of a plurality (four in the present embodiment) of panel side parts 30*a*, 30*b*, 30*c*, 30*d* (side parts) and a plurality (four in the present embodiment) of panel corner parts 30*e*, 30*f*, 30*g*, 30*h* (corner parts). The panel side parts 30*a*, 30*b*, 30*c*, 30*d* are disposed so that they correspond respectively to the side plates 22*a*, 22*b*, 22*c*, 22*d* of the casing main body 2*a*. The panel corner parts 30*e*, 30*f*, 30*g*, 30*h* are disposed so that they correspond respectively to the side plates 22*e*, 22*f*, 22*g*, 22*h* of the casing main body 2*a*.

The panel main body 3*a* comprises: an inlet 31 that, substantially at the center thereof, sucks in the air inside the air conditioned room, and a plurality (four in the present embodiment) of main outlets 32*a*, 32*b*, 32*c*, 32*d* formed corresponding respectively to the panel side parts 30*a*, 30*b*, 30*c*, 30*d* and that blow the air from inside the casing main body 2*a* out into the air conditioned room. The inlet 31 is a substantially square shaped opening in the present embodiment. The four main outlets 32*a*, 32*b*, 32*c*, 32*d* are substantially rectangular shaped openings that elongatingly extend so that they respectively run along the panel side parts 30*a*, 30*b*, 30*c*, 30*d*.

In addition, at the lower surface of the panel main body 3*a* is provided a square annular panel lower surface part 3*b* disposed so that it is surrounded by the inlet 31 and surrounds the four main outlets 32*a*, 32*b*, 32*c*, 32*d*. The panel lower surface part 3*b* comprises edge parts on the inlet 31 side of the main outlets 32*a*, 32*b*, 32*c*, 32*d*. Specifically, outer circumferential edge parts 39*a*, 39*b*, 39*c*, 39*d* corresponding to the four sides of the panel lower surface part 3*b* are disposed so that, in a plan view of the face panel 3, they overlap with portions of the main outlets 32*a*, 32*b*, 32*c*, 32*d* on the inlet 31 side.

Furthermore, an inlet grill 33, and a filter 34 for eliminating dust in the air sucked in from the inlet 31 are provided at the inlet 31.

In addition, horizontal flaps 35*a*, 35*b*, 35*c*, 35*d* (horizontal flaps) capable of oscillating about an axis in the longitudinal direction are respectively provided at the main outlets 32*a*, 32*b*, 32*c*, 32*d*. The horizontal flaps 35*a*, 35*b*, 35*c*, 35*d* are substantially rectangular shaped flap members elongatedly extending in the longitudinal direction of the respectively corresponding main outlets 32*a*, 32*b*, 32*c*, 32*d*, and linking pins 36 are respectively provided in the vicinity of both end parts in the longitudinal direction thereof. Furthermore, the horizontal flaps 35*a*, 35*b*, 35*c*, 35*d* are each rotatably supported to the face panel 3 by the linking pins 36, making them oscillatable about the axes of the main outlets 32*a*, 32*b*, 32*c*, 32*d* in the longitudinal direction. In the three panel corner parts 30*e*, 30*g*, 30*h*, excepting the panel corner part 30*f*, a linking shaft 37 serves as a link mechanism by mutually linking the adjoining linking pins 36. Taking the panel corner part 30*e* as an example, a linking shaft 37 links the linking pin 36 on the panel corner part 30*e* side of the horizontal flap 35*d* and the linking pin 36 on the panel corner part 30*e* side of the horizontal flap 35*a* so that they rotate by the rotation of the linking shaft 37. In addition, a drive shaft of a motor 38 is linked to the linking shaft 37 disposed in the panel corner part 30*h*. Thereby, driving the motor 38 synchronously oscillates the four horizontal flaps 35*a*, 35*b*, 35*c*, 35*d* vertically via the linking shafts 37, and via the linking pins 36 provided to the horizontal flaps 35*a*, 35*b*, 35*c*, 35*d*. Furthermore, oscillating these horizontal flaps 35*a*, 35*b*, 35*c*, 35*d* enables the wind direction of an air current X blown out from each of the main outlets 32*a*, 32*b*, 32*c*, 32*d* into the air conditioned room to be varied.

Figure 5:
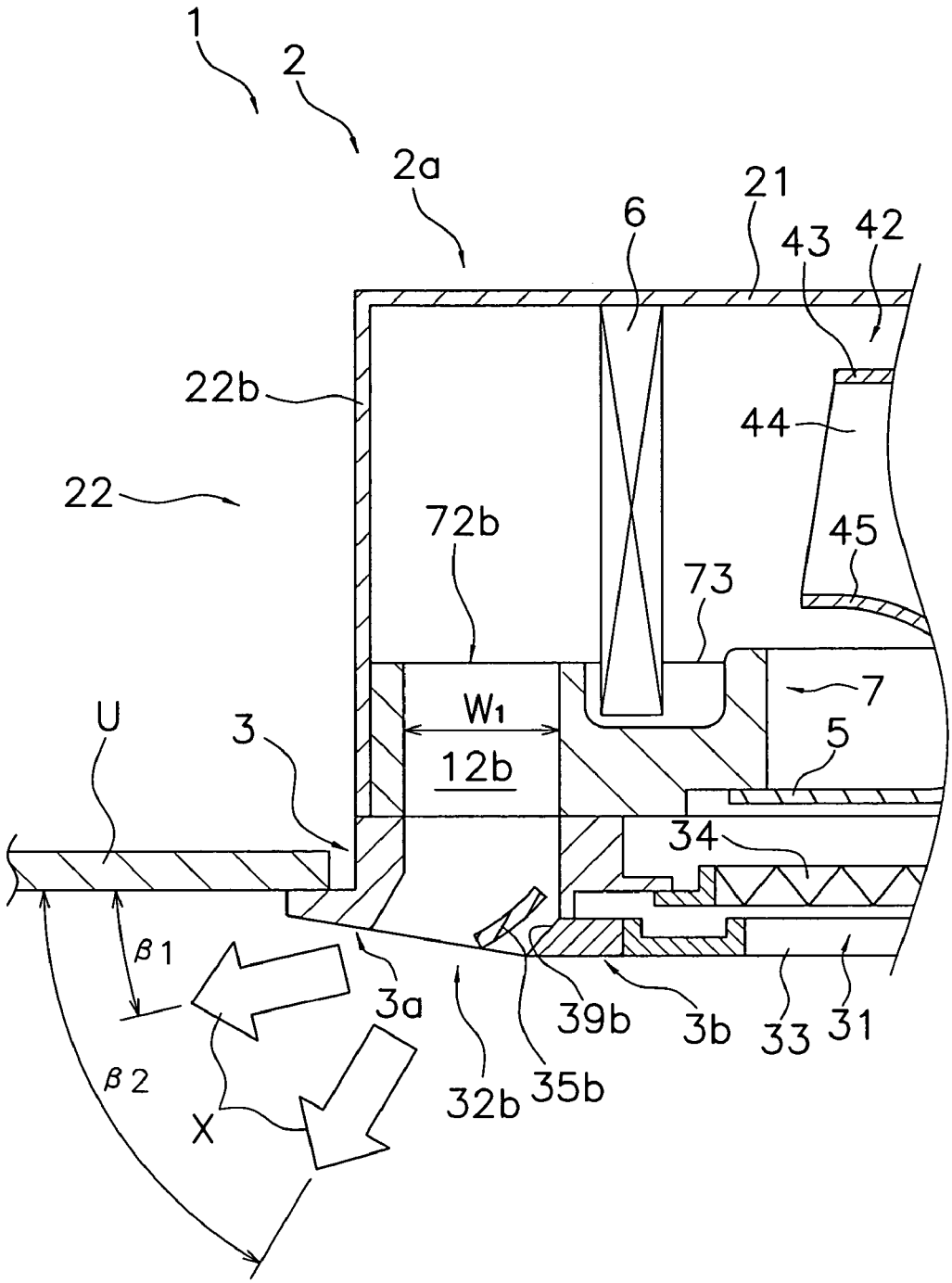
FIG. 5 is an enlarged view of FIG. 2, and depicts the vicinity of a main outlet passageway corresponding to a main outlet.

For example, as shown in FIG. 5, the wind direction of the air current X blown out from the main outlet 32*b* into the air conditioned room is varied in the vertical direction from an angle $\beta_1$ to an angle $\beta_2$ with respect to the lower surface of the ceiling U by the horizontal flap 35*b*. The wind direction of the air current blown out from each of the other main outlets 32*a*, 32*c*, 32*d* into the air conditioned room are likewise varied in the vertical direction from the angle $\beta_1$ to the angle $\beta_2$ with respect to the lower surface of the ceiling U, the same as the wind direction of the air current X blown out from the main outlet 32*b* into the air conditioned room. Here, FIG. 5 is an enlarged view of FIG. 2, and depicts the vicinity of a main outlet passageway 12*b* (discussed later) corresponding to the main outlet 32*b*.

Principally disposed inside the casing main body 2*a* are: a fan 4 that sucks the air inside the air conditioned room through the inlet 31 of the face panel 3 into the casing main body 2*a*, and blows the same out in the outer circumferential direction; and a heat exchanger 6 disposed so that it surrounds the outer circumference of the fan 4.

The fan 4 in the present embodiment is a turbofan, and comprises: a fan motor 41 provided in the center of the top plate 21 of the casing main body 2*a*; and an impeller 42 linked to and rotatably driven by the fan motor 41. The impeller 42 comprises: a disc shaped end plate 43 linked to the fan motor 41; a plurality of blades 44 provided at the outer circumferential part of the lower surface of the end plate 43; and a disc shaped end ring 45 provided on the lower side of the blade 44 and having an opening at the center. The fan 4 can suck in air through the opening of the end ring 45 to the interior of the impeller 42 by the rotation of the blades 44, and can blow out the air sucked into the impeller 42 to the outer circumferential side of the impeller 42.

In the present embodiment, the heat exchanger 6 is a cross finned tube type heat exchanger panel formed bent so that it surrounds the outer circumference of the fan 4, and is connected via the refrigerant piping to the outdoor unit (not shown) installed outdoors, and the like. The heat exchanger 6 can function as an evaporator of the refrigerant flowing internally during cooling operation, and as a condenser of the refrigerant flowing internally during heating operation. Thereby, the heat exchanger 6 exchanges heat with the air sucked in by the fan 4 through the inlet 31 into the casing main body 2*a*, and can cool the air during cooling operation and heat the air during heating operation.

A drain pan 7 is disposed on the lower side of the heat exchanger 6 for receiving drain water generated by the condensation of water in the air in the heat exchanger 6. The drain pan 7 is attached to the lower part of the casing main body 2*a*. The drain pan 7 comprises: an inlet hole 71 formed so that it communicates with the inlet 31 of the face panel 3; four main outlet holes 72*a*, 72*b*, 72*c*, 72*d* formed so that they communicate with the main outlets 32*a*, 32*b*, 32*c*, 32*d* of the face panel 3; and a drain water receiving groove 73 formed on the lower side of the heat exchanger 6 and that receives the drain water. Here, the main outlet holes 72*a*, 72*b*, 72*c*, 72*d* are shorter than the lengths of the respective corresponding main outlets 32*a*, 32*b*, 32*c*, 32*d* in the longitudinal direction. In particular, the main outlet hole 72*c* is shorter than the lengths of the other main outlet holes 72*a*, 72*b*, 72*d* in the longitudinal direction because it is interposed between: a drain pump 8 for discharging the drain water collected in the drain water receiving groove 73 disposed on the side plate 22*g* side; and the portion through which the refrigerant piping passes on the side plate 22*h* side.

Furthermore, with the inlet 31 of the face panel 3, the inlet hole 71 forms an inlet passageway that serves as the substantial inlet that sucks in the air inside the air conditioned room into the casing main body 2*a*. In addition, the main outlet holes 72*a*, 72*b*, 72*c*, 72*d*, in conjunction with the main outlets 32*a*, 32*b*, 32*c*, 32*d* of the face panel 3, which communicate respectively therewith, form main outlet passageways 12*a*, 12*b*, 12*c*, 12*d* that serve as the substantial main outlets that blow out the air whose heat was exchanged in the heat exchanger 6 into the air conditioned room. In other words, with the air conditioner 1 of the present embodiment, the lower part of the casing 2 comprises the face panel 3 and the drain pan 7, and at the lower part of this casing 2 are formed the inlet passageway and main outlet passageways 12*a*, 12*b*, 12*c*, 12*d* (side part outlets) that serve as the substantial inlet and main outlets.

In addition, a bell mouth 5 for guiding the air sucked in from the inlet 31 to the impeller 42 of the fan 4 is disposed in the inlet hole 71 of the drain pan 7.

(2) Auxilliary Outlet Structure, and Peripheral Configuration Thereof

Figure 6:
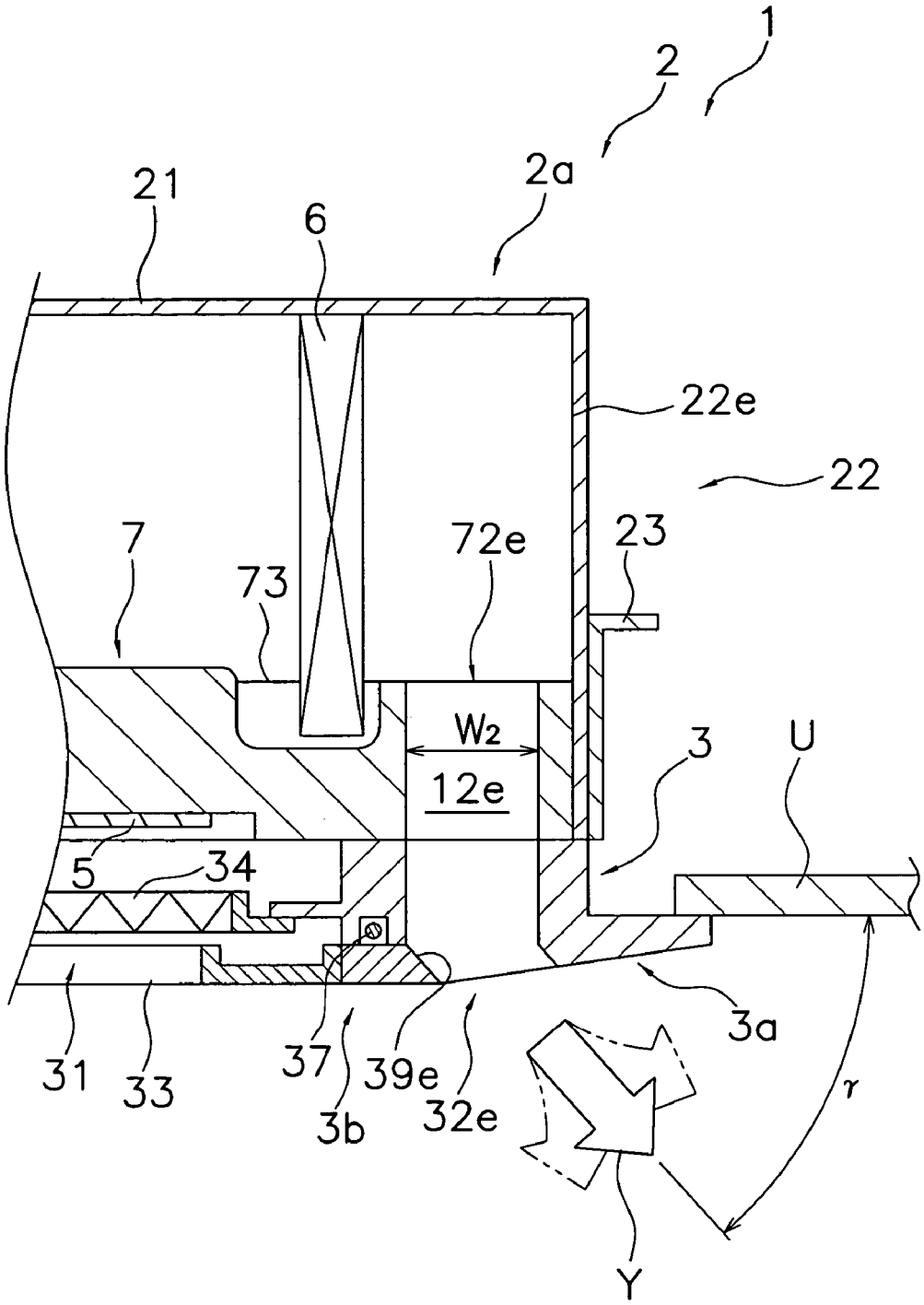
FIG. 6 is an enlarged view of FIG. 2, and depicts the vicinity of an auxiliary outlet passageway corresponding to an auxiliary outlet.
Figure 7:
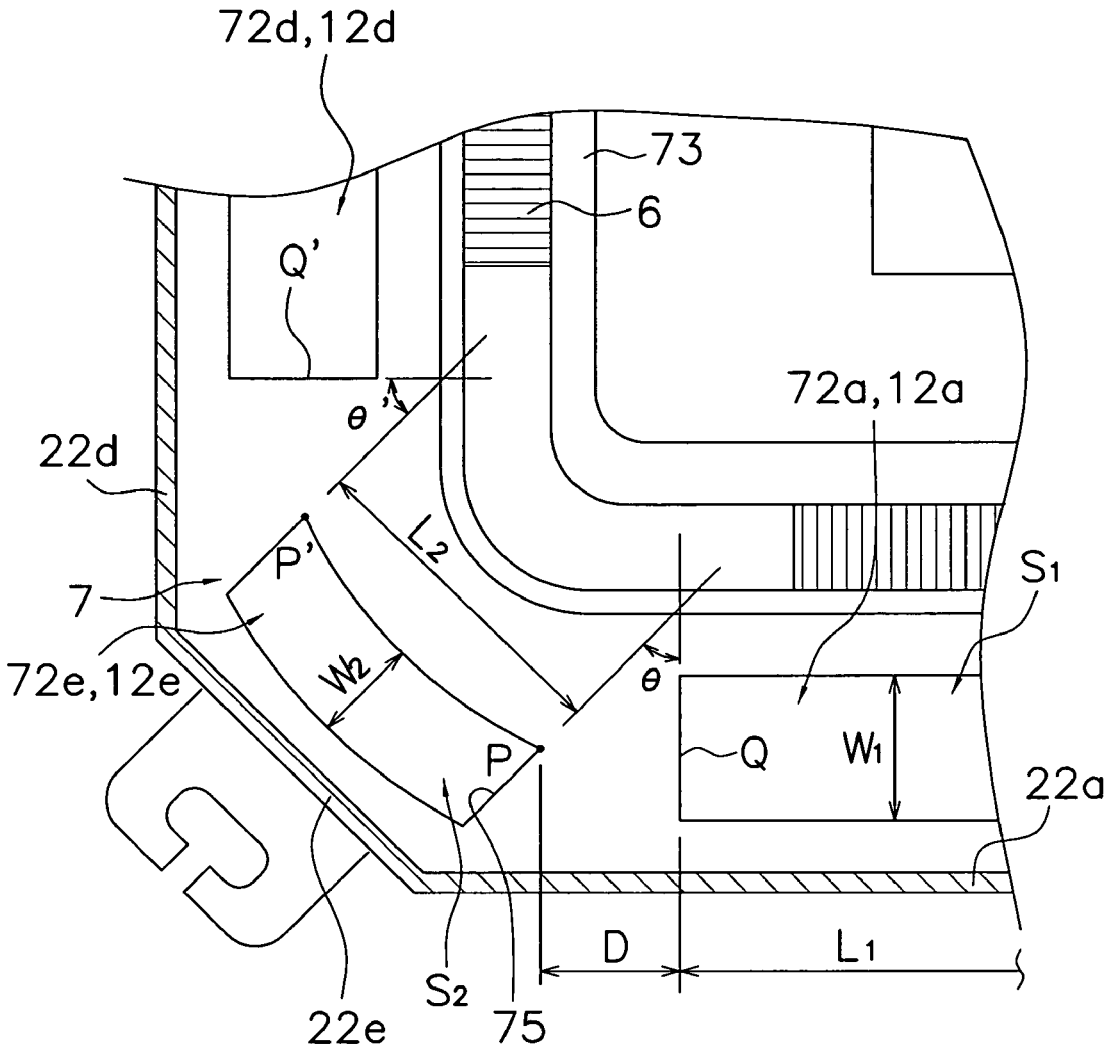
FIG. 7 is an enlarged view of FIG. 3, and depicts the vicinity of an auxiliary outlet passageway corresponding to an auxiliary outlet.

The air conditioner 1 having the basic constitution as described above further comprises a plurality (four in the present embodiment) of auxiliary outlets 32*e*, 32*f*, 32*g*, 32*h* formed so that they correspond respectively to the panel corner parts 30*e*, 30*f*, 30*g*, 30*h* of the face panel 3, and that blow the air from inside the casing main body 2*a* out into the air conditioned room, as shown in FIG. 1 through FIG. 7. Here, FIG. 6 is an enlarged view of FIG. 2, and depicts the vicinity of the auxiliary outlet passageway 12*e* (discussed later) corresponding to the auxiliary outlet 32*e*. FIG. 7 is an enlarged view of FIG. 3, and depicts the vicinity of the auxiliary outlet passageway 12*e* corresponding to the auxiliary outlet 32*e*.

The four auxiliary outlets 32*e*, 32*f*, 32*g*, 32*h* are, in a plan view of the face panel 3, substantially rectangular shaped openings formed so that they respectively run along the side plates 22*e*, 22*f*, 22*g*, 22*h* of the casing main body 2*a*.

In addition, the portions of the auxiliary outlets 32*e*, 32*f*, 32*g*, 32*h* on the inlet 31 side are disposed, in a plan view of the face panel 3, so that they overlap the outer circumferential corner parts 39*e*, 39*f*, 39*g*, 39*h* between the outer circumferential edge parts 39*a*, 39*b*, 39*c*, 39*d* of the panel lower surface part 3*b*. Consequently, the panel lower surface part 3*b* comprises not only the edge parts of the main outlets 32*a*, 32*b*, 32*c*, 32*d* on the inlet 31 side, but also the edge parts of the auxiliary outlets 32*e*, 32*f*, 32*g*, 32*h* on the inlet 31 side. Further, the surfaces on the auxiliary outlets 32*e*, 32*f*, 32*g*, 32*h* side of these outer circumferential corner parts 39*e*, 39*f*, 39*g*, 39*h* are formed so that the air blown out from each of the auxiliary outlets 32*e*, 32*f*, 32*g*, 32*h* into the air conditioned room is blown out in an inclined, downward, fixed direction.

Moreover, a horizontal flap for varying the wind direction of the blown-out air current is not provided at each of the auxiliary outlets 32*e*, 32*f*, 32*g*, 32*h*, unlike the main outlets 32*a*, 32*b*, 32*c*, 32*d*. Further, for example, as shown in FIG. 6, the wind direction of the air current blown out from the auxiliary outlet 32*e* into the air conditioned room is a direction formed by the angle $\gamma(\approx\beta 1/2+\beta 2/2)$, which is the direction of substantially the middle of the range by which the horizontal flaps 35*d*, 35*a* provided at the adjoining main outlets 32*d*, 32*a* regulate in the vertical direction the wind direction of the air current blown out from each of the main outlets 32*d*, 32*a* (specifically, the range from the angle $\beta 1$ to the angle $\beta 2$ with respect to the lower surface of the ceiling U). The wind direction of the air current blown out from each of the other auxiliary outlets 32*f*, 32*g*, 32*h* into the air conditioned room are also the direction formed by the angle $\gamma$ with respect to the lower surface of the ceiling U, the same as the wind direction of the air current Y blown out from the auxiliary outlet 32*e* into the air conditioned room.

In addition, the drain pan 7 further comprises three auxiliary outlet holes 72*e*, 72*f*, 72*g* formed so that they communicate with the auxiliary outlets 32*e*, 32*f*, 32*g* of the face panel 3. Here, in the present embodiment, an auxiliary outlet hole is not formed at the position corresponding to the auxiliary outlet 32*h* of the face panel 3 of the drain pan 7. Consequently, in the present embodiment, the auxiliary outlet 32*h* of the face panel 3 does not have the function of blowing the air sucked into the casing main body 2*a* out toward the inside of the air conditioned room. Here, the auxiliary outlet hole 72*e* is substantially the same length as the corresponding auxiliary outlet 32*e* in the longitudinal direction, but the auxiliary outlet hole 72*f* is shorter than the length of the corresponding auxiliary outlet 32*f* in the longitudinal direction because one part of the drain water receiving groove 73 protrudes on the side plate 22*a* side. In addition, the auxiliary outlet hole 72*g* is shorter than the length of the corresponding auxiliary outlet 32*g* in the longitudinal direction because the drain pump 8 is disposed on the side plate 22*c* side.

Furthermore, the three auxiliary outlet holes 72*e*, 72*f*, 72*g*, in conjunction with the auxiliary outlets 32*e*, 32*f*, 32*g* of the face panel 3, which communicates therewith, form three auxiliary outlet passageways 12*e*, 12*f*, 12*g* that blow the air whose heat was exchanged in the heat exchanger 6 out into the air conditioned room. In other words, with the air conditioner 1 of the present embodiment, the following are formed at the lower part of the casing 2 comprising the face panel 3 and the drain pan 7: the inlet passageway and the main outlet passageways 12*a*, 12*b*, 12*c*, 12*d* that serve as the substantial inlet and main outlets; and the auxiliary outlet passageways 12*e*, 12*f*, 12*g* (corner part outlets) that serve as the substantial auxiliary outlets.

If the auxiliary outlet passageways 12*e*, 12*f*, 12*g* are provided between the main outlet passageways 12*a*, 12*b*, 12*c*, 12*d* in this manner, then the inlet 31 becomes surrounded by these outlet passageways, making it difficult to ensure a passageway for the air sucked in from inside the air conditioned room into the casing 2; as a result, the air current X and the air current Y respectively blown out from each of the main outlet passageways 12*a*, 12*b*, 12*c*, 12*d* and each of the auxiliary outlet passageways 12*e*, 12*f*, 12*g* toward the inside of the air conditioned room are short circuited, and sucked into the inlet 31.

However, in the air conditioner 1 of the present embodiment, by making the spacing between each of the auxiliary outlet passageways 12*e*, 12*f*, 12*g* and the main outlet passageways 12*a*, 12*b*, 12*c*, 12*d* adjacent to that auxiliary outlet passageway 12*e*, 12*f*, 12*g* satisfy the prescribed relational expression explained below, it is possible to ensure passageways, between each of the auxiliary outlet passageways 12*e*, 12*f*, 12*g* and the main outlet passageways 12*a*, 12*b*, 12*c*, 12*d* adjacent to that auxiliary outlet passageway 12*e*, 12*f*, 12*g*, for the air sucked into the inlet 31 from the outer circumferential side of the inlet 31.

The following explains the dimensional relationship between each of the auxiliary outlet passageways 12*e*, 12*f*, 12*g* and the main outlet passageways 12*a*, 12*b*, 12*c*, 12*d* adjacent to that auxiliary outlet passageway 12*e*, 12*f*, 12*g*, taking as an example the dimensional relationship between the auxiliary outlet passageway 12*e* and the main outlet passageway 12*a* adjacent to that auxiliary outlet passageway 12*e*.

Here, because the dimensional relationship between the auxiliary outlet passageway 12*e* and the main outlet passageway 12*d* adjacent to that auxiliary outlet passageway 12*e* is the same for the dimensional relationships between the other auxiliary outlet passageways 12*f*, 12*g* and the main outlet passageways 12*a*, 12*b*, 12*c*, 12*d*, the explanation thereof is omitted.

If we let D be the distance between point P (first proximate part), which is the most proximate part of the auxiliary outlet passageway 12*e* to the main outlet passageway 12*a*, and side Q (second proximate part), which is the most proximate part of the main outlet passageway 12*a* to the auxiliary outlet passageway 12*e*, $L_1$ be the length of the main outlet passageway 12*a* in the direction along the outer circumferential edge of the side part 30*a* (i.e., the side plate 22*a*), $W_1$ be the width of the main outlet passageway 12*a* in the direction orthogonal to the side plate 22*a*, and $S_2$ be the opening area of the auxiliary outlet passageway 12*e*, then the dimensional relationship between the auxiliary outlet passageway 12*e* and the main outlet passageway 12*a* adjacent to that auxiliary outlet passageway 12*e* is:

$$D/(L_1W_1+S_2)^{0.5}>0.15.$$

Here, the opening area $S_2$ of the auxiliary outlet passageway 12*e* is, in a plan view of the casing 2, the opening area of the portion where the opening area from the auxiliary outlet hole 72*e* to the auxiliary outlet 32*e* is smallest, and is equivalent to the opening area of the auxiliary outlet hole 72*e* in the present embodiment. Furthermore, if the shape of the auxiliary outlet hole 72*e* is substantially square shaped as in the present embodiment, then the opening area $S_2$ is equivalent to the value of the sum of $L_2$, which is the length between the point P of the auxiliary outlet passageway 12*e* and the point P', which is the most proximate part of the auxiliary outlet passageway 12*e* to the main outlet passageway 12*d*, and width $W_2$ in the direction orthogonal to the line mutually linking the point P and the point P' of the auxiliary outlet passageway 12*e* ($\approx L_2W_2$).

Moreover, because the value of the sum of $L_1$, which is the length of the main outlet passageway 12*a* in the direction along the side plate 22*a*, and $W_1$, which is the width of the main outlet passageway 12*a* in the direction orthogonal to the side plate 22*a* ($=L_1W_1$), is equivalent to the opening area $S_1$ of the main outlet passageway 12*a*, the abovementioned dimensional relationship prescribes the minimum spacing capable of ensuring passageways, between each of the auxiliary outlet passageways 12*e*, 12*f*, 12*g* and the main outlet passageways 12*a*, 12*b*, 12*c*, 12*d* adjacent to that auxiliary outlet passageway 12*e*, 12*f*, 12*g* in accordance with the opening size of the main outlet passageways 12*a*, 12*b*, 12*c*, 12*d* and the auxiliary outlet passageways 12*e*, 12*f*, 12*g*, for the air sucked into the inlet 31 from the outer circumferential side of the inlet 31.

In addition, the opening area $S_2$ of each of the auxiliary outlet passageways 12*e*, 12*f*, 12*g* is less than the opening area $S_1$ of each of the main outlet passageways 12*a*, 12*b*, 12*c*, 12*d*.

Furthermore, the circumferential edge parts of the auxiliary outlet passageways 12*e*, 12*f*, 12*g* are formed so that the air current Y blown out from each of the auxiliary outlet passageways 12*e*, 12*f*, 12*g* is blown out in a direction away from the air current X blown out from each of the adjacent two main outlet passageways 12*a*, 12*b*, 12*c*, 12*d*. Taking the auxiliary outlet passageway 12*e* as an example, in the present embodiment, the auxiliary outlet passageway 12*e* is formed so that angles θ, θ' formed between end surfaces 74, 75 on the main outlet passageways 12*a*, 12*d* side thereof and the sides Q, Q' of the adjacent main outlet passageways 12*a*, 12*d* is a positive value (e.g., 45°, and the like).

(3) Operation of the Air Conditioner

Figure 8:
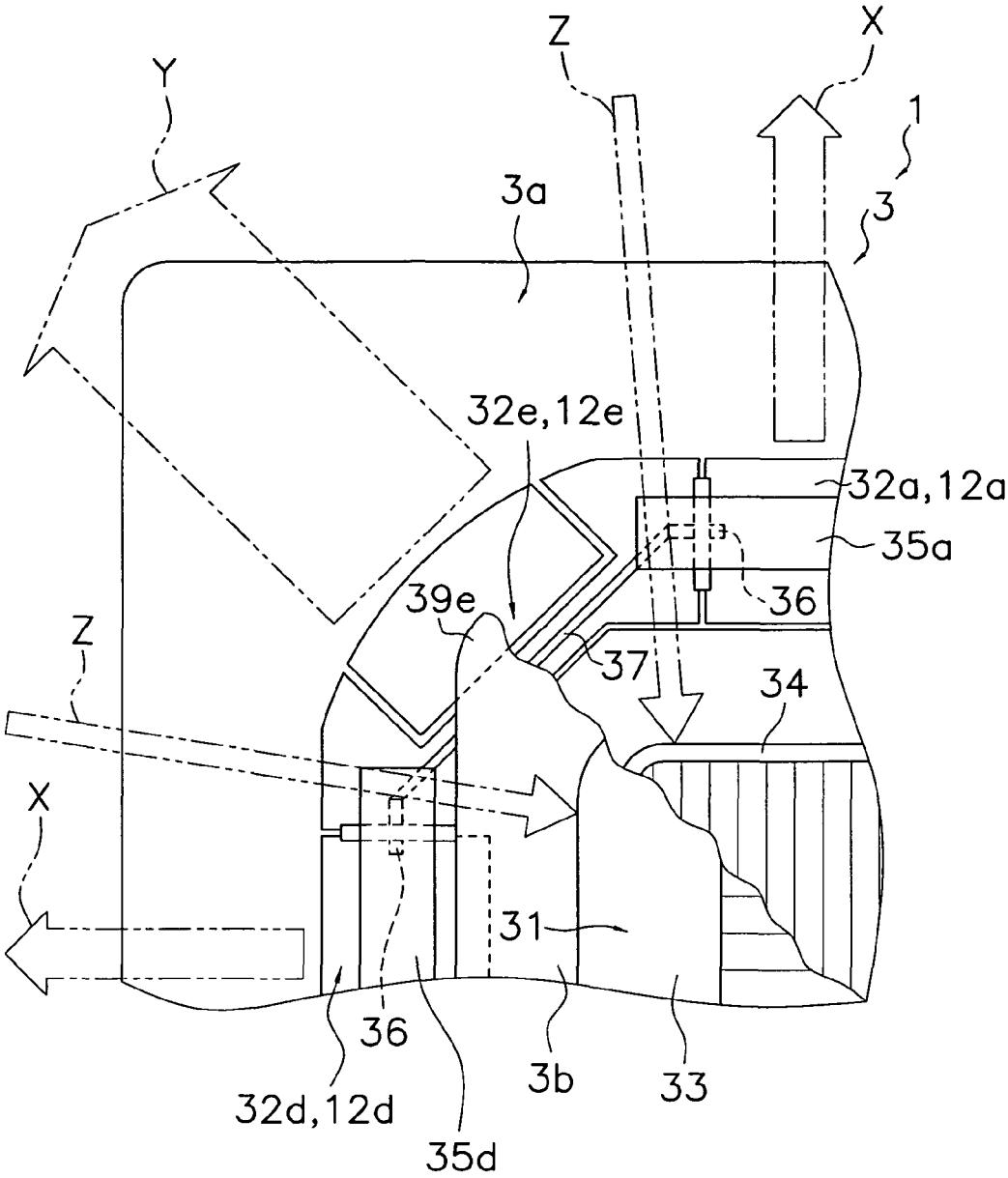
FIG. 8 is an enlarged view of FIG. 4, and depicts the vicinity of an auxiliary outlet (a partial broken view of a panel lower surface part).

The following explains the operation of the air conditioner 1, referencing FIG. 2, FIG. 4, FIG. 5, FIG. 6, and FIG. 8. Here, FIG. 8 is an enlarged view of FIG. 4, and depicts the vicinity of the auxiliary outlet 32*e* (a partial broken view of the panel lower surface part 3*b*).

When operation starts, the fan motor 41 is driven, which rotates the impeller 42 of the fan 4. In addition, along with the driving of the fan motor 41, refrigerant is supplied from the outdoor unit (not shown) to the inside of the heat exchanger 6. Here, the heat exchanger 6 functions as an evaporator during cooling operation, and as a condenser during heating operation. Further, attendant with the rotation of the impeller 42, the air inside the air conditioned room is sucked from the inlet 31 of the face panel 3 through the filter 34 and the bell mouth 5 into the casing main body 2*a* from the lower side of the fan 4. This sucked in air is blown out to the outer circumferential side by the impeller 42, reaches the heat exchanger 6, is cooled or heated in the heat exchanger 6, and then blown through the main outlet holes 72*a*, 72*b*, 72*c*, 72*d* and the main outlets 32*a*, 32*b*, 32*c*, 32*d* (i.e., the main outlet passageways 12*a*, 12*b*, 12*c*, 12*d*), and the auxiliary outlet holes 72*e*, 72*f*, 72*g* and the auxiliary outlets 32*e*, 32*f*, 32*g* (i.e., the auxiliary outlet passageways 12*e*, 12*f*, 12*g*) out into the air conditioned room. In so doing, the inside of the air conditioned room is cooled or heated.

Here, the auxiliary outlet passageways 12*e*, 12*f*, 12*g* are respectively disposed in the panel corner parts 30*e*, 30*f*, 30*g* with a spacing that satisfies the dimensional relationship formula explained above, in accordance with the opening sizes of the respective main outlet passageways 12*a*, 12*b*, 12*c*, 12*d* and auxiliary outlet passageways 12*e*, 12*f*, 12*g*. Thereby, it is possible to ensure passageways, between each of the auxiliary outlet passageways 12*e*, 12*f*, 12*g* and the main outlet passageways 12*a*, 12*b*, 12*c*, 12*d* adjacent to that auxiliary outlet passageway 12*e*, 12*f*, 12*g*, for the air sucked into the inlet 31.

Taking the auxiliary outlet passageway 12*e* as an example, by setting the spacing between the auxiliary outlet passageway 12*e* and the adjacent main outlet passageway 12*a* to be the distance D, a passageway for the air sucked into the inlet 31 can be ensured and, consequently, an air current Z from the outer circumferential direction of the face panel 3 can be introduced into the inlet 31, thereby enabling a reduction in the short circuit. Furthermore, because the spacing between the auxiliary outlet passageway 12*e* and the main outlet passageway 12*d* adjacent to the auxiliary outlet passageway 12*e* can ensure a passageway for the air sucked into the inlet 31, the same as with the spacings between the other auxiliary outlet passageways 12*f*, 12*g* and the main outlet passageways 12*a*, 12*b*, 12*c*, 12*d* adjacent to those other auxiliary outlet passageways 12*f*, 12*g*, air from the outer circumferential direction of the face panel 3 can be introduced into the inlet 31, thereby reducing short circuits.

In addition, the wind direction of the air current X blown from each of the main outlets 32*a*, 32*b*, 32*c*, 32*d* out into the air conditioned room is regulated by the horizontal flaps 35*a*, 35*b*, 35*c*, 35*d* to within the wind direction regulation range (specifically, the range from the angle $\beta_1$ to the angle $\beta_2$ with respect to the lower surface of the ceiling U). However, the air current Y blown from each of the auxiliary outlets 32*e*, 32*f*, 32*g* out into the air conditioned room is blown out in the direction of the angle γ, which is the direction of substantially the middle of the wind direction regulation range of the horizontal flaps 35*a*, 35*b*, 35*c*, 35*d* with respect to the lower surface of the ceiling U.

However, taking the auxiliary outlet 32*e* as an example, the auxiliary outlet 32*e* is disposed at the panel corner part 30*e* adjoining the main outlet 32*d* and the main outlet 32*a*, and is consequently easily affected by the air current X blown out from the main outlet 32*d* and the main outlet 32*a* into the air conditioned room. Specifically, the air current Y blown out from the auxiliary outlet 32*e* is dragged by the air current X blown out from the adjoining main outlet 32*d* and main outlet 32*a*, and its direction tends to vary. Consequently, the oscillation by the horizontal flaps 35*d*, 35*a* provided at the main outlets 32*d*, 32*a* changes the direction of the air current Y blown out from the auxiliary outlet 32*e* so that it proceeds in a direction the same as the wind direction of this air current X.

Thereby, if the wind direction of the air current X blown out from each of the main outlets 32*d*, 32*a* is regulated to an angle less than the wind direction of the air current Y (i.e., the direction of the angle γ with respect to the lower surface of the ceiling U) blown out from the auxiliary outlet 32*e*, then the wind direction of the air current Y blown out from the auxiliary outlet 32*e* is dragged thereby, and becomes less than the angle γ. Conversely, if the wind direction of the air current X blown out from each of the main outlets 32*d*, 32*a* is regulated to an angle greater than the wind direction of the air current Y (i.e., the direction of the angle γ with respect to the lower surface of the ceiling U) blown out from the auxiliary outlet 32*e*, then the wind direction of the air current Y blown out from the auxiliary outlet 32*e* is dragged thereto, and becomes greater than the angle γ.

Thus, the wind direction of the air current Y blown out from the auxiliary outlet 32*e* can be varied even if blown out in a fixed direction, without providing a mechanism, such as the horizontal flaps, for varying in the vertical direction the wind direction of the air blown out from the auxiliary outlet 32*e*. Furthermore, the blow-out direction of the air current Y for each of the other auxiliary outlets 32*f*, 32*g* can also be varied in accordance with changes in the wind direction of the air current X blown out from each of the contiguous main outlets, without providing a mechanism, such as the horizontal flaps, the same as the auxiliary outlet 32*e*.

Incidentally, if the phenomenon occurs where the air current Y blown out from each of the auxiliary outlets 32*e*, 32*f*, 32*g* into the air conditioned room, as described above, is dragged by the air current X blown out from each of the main outlets 32*a*, 32*b*, 32*c*, 32*d* into the air conditioned room, then it would result in a situation where the inlet 31 is surrounded by the air currents X and the air currents Y, which tends to produce short circuits; however, even in such a situation, by disposing the auxiliary outlets 32*e*, 32*f*, 32*g* and the main outlets 32*a*, 32*b*, 32*c*, 32*d* with a spacing that satisfies the dimensional relationship formula explained above, passageways between each of the auxiliary outlets 32*e*, 32*f*, 32*g* and the main outlets 32*a*, 32*b*, 32*c*, 32*d* can be ensured for the air sucked into the inlet 31, thereby reducing short circuits.

In addition, because the opening area $S_2$ of each of the auxiliary outlet passageways 12*e*, 12*f*, 12*g* is less than the opening area $S_1$ of each of the main outlet passageways 12*a*, 12*b*, 12*c*, 12*d* and the flow speed of the air blown out from each of the main outlet passageways 12*a*, 12*b*, 12*c*, 12*d* does not drop significantly, the air current X blown out from each of the main outlet passageways 12*a*, 12*b*, 12*c*, 12*d* can be made to reach as far as possible. Moreover, because the flow speed of the air blown out from each of the auxiliary outlet passageways 12*e*, 12*f*, 12*g* is small and a difference is created in the reach between the air current Y blown out from each of the auxiliary outlet passageways 12*e*, 12*f*, 12*g* and the air current X blown out from each of the main outlet passageways 12*a*, 12*b*, 12*c*, 12*d*, it is possible to ensure a passageway, below the air current Y blown out from each of the auxiliary outlet passageways 12*e*, 12*f*, 12*g*, for the air sucked into the inlet 31.

Furthermore, because the circumferential edge parts (specifically, the end surfaces 74, 75) of the auxiliary outlet passageways 12*e*, 12*f*, 12*g* are formed so that the air current Y blown out from each of the auxiliary outlet passageways 12*e*, 12*f*, 12*g* is blown out in a direction away from the air current X blown out from each of the two adjacent main outlet passageways 12*a*, 12*b*, 12*c*, 12*d*, it is even easier to ensure a passageway for the air sucked into the inlet 31.

(4) Other Embodiments

The above explained an embodiment of the present invention based on the drawings, but the specific constitution is not limited to these embodiments, and it is understood that variations and modifications may be effected without departing from the spirit and scope of the invention.

(A)

Figure 9:
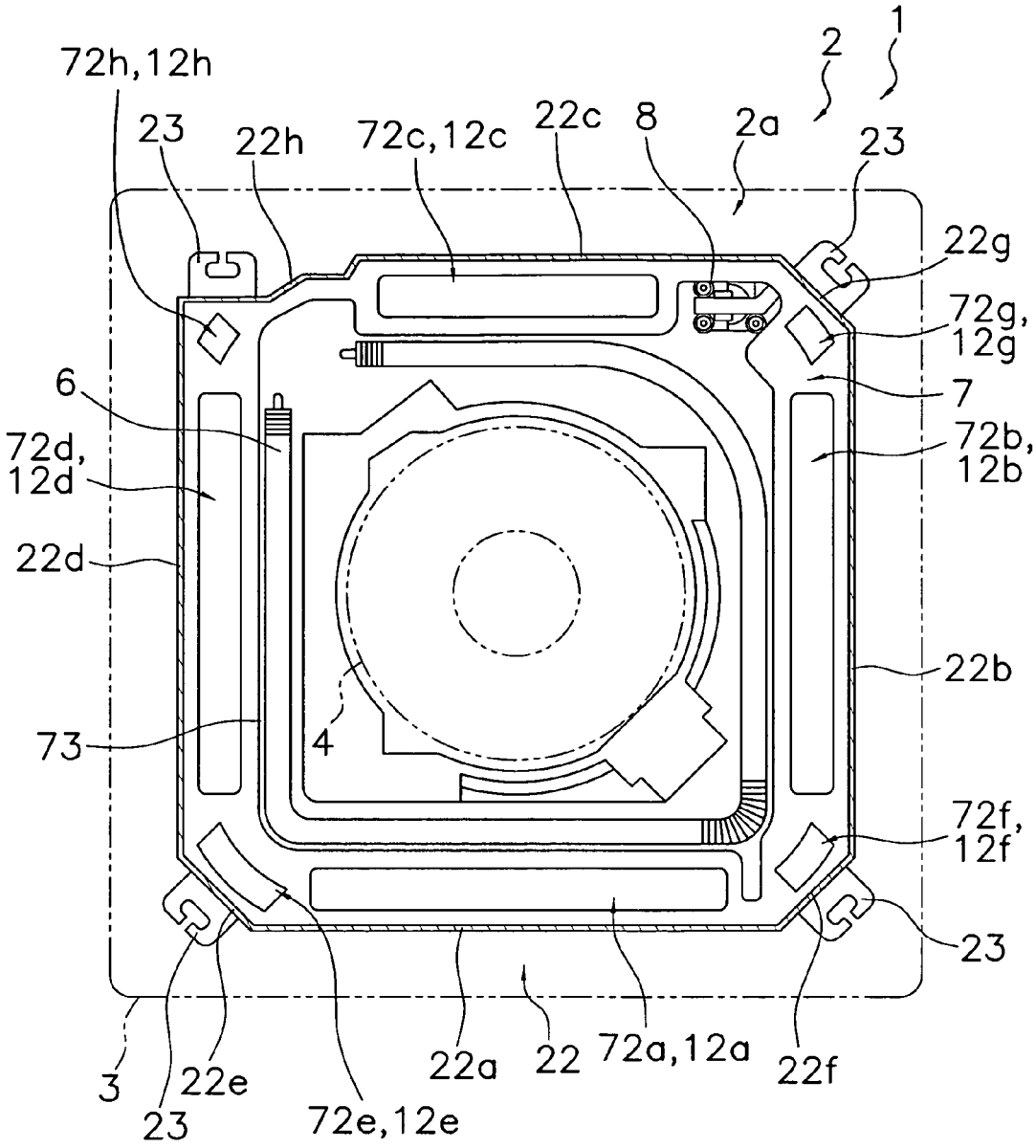
FIG. 9 is a schematic plan cross sectional view of the air conditioner according to another embodiment, and is a view that corresponds to FIG. 3.

In the abovementioned embodiment, although the auxiliary outlets 32*e*, 32*f*, 32*g*, 32*h* are formed so that they correspond to all of the panel corner parts 30*e*, 30*f*, 30*g*, 30*h*, an auxiliary outlet hole corresponding to the auxiliary outlet 32*h* is not provided in the drain pan 7; consequently, of the four auxiliary outlets 32*e*, 32*f*, 32*g*, 32*h*, only the three auxiliary outlets 32*e*, 32*f*, 32*g* function as substantial auxiliary outlets and the air inside the casing main body 2*a* may be blown out from the auxiliary outlet 32*h* into the air conditioned room by forming the auxiliary outlet hole 72*h* also at a position corresponding to the auxiliary outlet 32*h* of the drain pan 7, and by providing the auxiliary outlet passageway 12*h*, as shown in FIG. 9 (a schematic plan cross sectional view of the air conditioner according to another embodiment, and a view equivalent to FIG. 3). Thereby, the air can be blown from all four panel side parts 30*a*, 30*b*, 30*c*, 30*d* and all four panel corner parts 30*e*, 30*f*, 30*g*, 30*h* of the face panel 3 out into the air conditioned room, and the distribution of the air blown out into the air conditioned room can be made further satisfactory.

(B)

Figure 10:
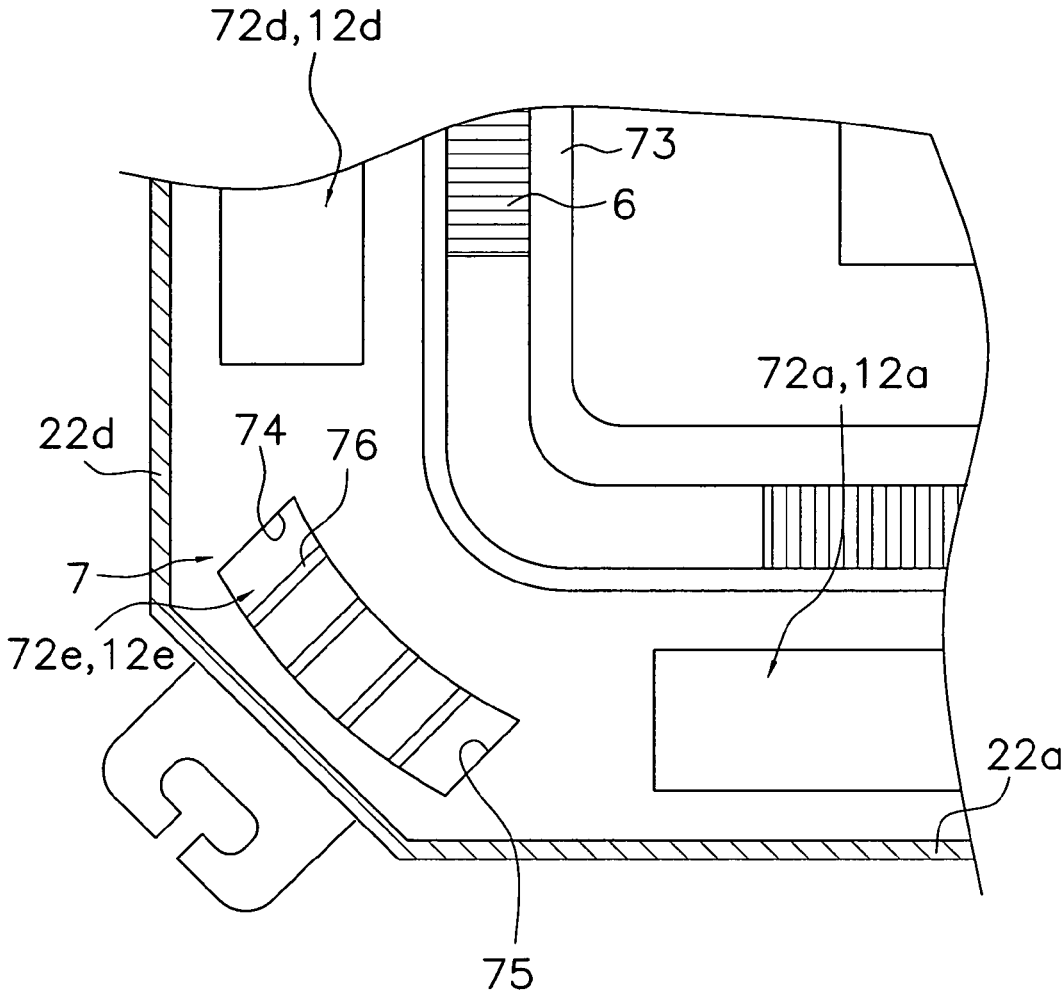
FIG. 10 depicts the vicinity of an auxiliary outlet passageway corresponding to an auxiliary outlet according to another embodiment, and is a view that corresponds to FIG. 7.

In the abovementioned embodiment, forming the circumferential edge parts (specifically, the end surfaces 74, 75) of each of the auxiliary outlet passageways 12*e*, 12*f*, 12*g* so that the air current Y blown out from each of the auxiliary outlet passageways 12*e*, 12*f*, 12*g* is blown out in a direction away from the air current X blown out from each of the two adjacent main outlet passageways 12*a*, 12*b*, 12*c*, 12*d* makes it easier to ensure passageways for the air sucked into the inlet 31; however, as shown in FIG. 10 (a drawing that depicts the vicinity of the auxiliary outlet passageway 12*e* corresponding to the auxiliary outlet 32*e* according to another embodiment, and equivalent to FIG. 7) and taking the auxiliary outlet passageway 12*e* as an example, it is also acceptable to provide a plurality (four in the present embodiment) of guide flaps 76 inside the auxiliary outlet passageway 12*e* that guides the air current Y blown out from the auxiliary outlet passageway 12*e* so that it is blown out in a direction away from the air current X blown out from each of the adjacent two main outlet passageways 12*a*, 12*d*.

(C)

In the abovementioned embodiment, the auxiliary outlet passageways 12*e*, 12*f*, 12*g*, 12*h* are formed so that they correspond to three or four of the four panel corner parts 30*e*, 30*f*, 30*g*, 30*h*; however, it is also acceptable to provide auxiliary outlet passageways in just one or two of the four panel corner parts 30*e*, 30*f*, 30*g*, 30*h*. Even in this case, by disposing the auxiliary outlet passageways in the panel corner parts with a spacing that satisfies the dimensional relationship formula explained above, it is possible to ensure passageways between adjacent main outlet passageways for the air sucked into the inlet 31, thereby reducing short circuits.

(D)

In the abovementioned embodiments, the present embodiment was applied to a ceiling embedded type air conditioner 1 having a substantially square shaped face panel 3, but is also applicable to a ceiling embedded type air conditioner 1 having a polygonal face panel having five or more sides.

INDUSTRIAL FIELD OF APPLICATION

Using the present invention enables, in a ceiling embedded type air conditioner wherein the outlets are disposed so that they surround the inlet, a reduction in short circuits without increasing drafts due to air currents blown out from the outlets.

What is claimed is:

1. An air conditioner embedded in the ceiling of an air conditioned room, comprising:

a face panel including a panel main body being formed by an alternating sequence of a plurality of side parts and a plurality of corner parts, a plurality of side part outlets with one being disposed along each of said side parts, each of said plurality of side part outlets having a horizontal flap being rotatably supported in each of said plurality of side part outlets in a longitudinal direction of each of said plurality of side part outlets, each of said horizontal flaps being configured to oscillate about an axis in the longitudinal direction to enable wind direction of the air current blown from each of said plurality of side part outlets, a plurality of corner part outlets being disposed in said corner parts, each of said corner part outlets being formed so that air is blown out from each of said corner part outlets in a fixed direction, and an inlet surrounded by all of said side parts;

a box shaped casing main body having an open lower end; and a drain pan attached to the lower end of said casing main body, said drain pan including an inlet hole arranged to communicate with said inlet of said face panel, side part outlet holes arranged to communicate with said side part outlets of said face panel, and corner part outlet holes arranged to communicate with said corner part outlets of said face panel, a fan being disposed inside said casing and configured to take air from said inlet into said casing, and blow said air from said side part outlets and said corner part outlets into said air conditioned room, each of said corner part outlet holes and a corresponding one of said side part outlet holes adjacent to a corresponding one of said corner part outlet holes having a dimensional relationship therebetween of $$D/(L_1W_1+S_2)^{0.5}>0.15$$

where D is a distance between a first proximate part, which is a most proximate part of each of said corner part outlet holes to a corresponding one of said side part outlet holes, and a second proximate part, which is a most proximate part of each of said side part outlet holes to a corresponding one of said corner part outlet, $L_1$ is a length of each of said side part outlet holes in a direction along an outer circumferential edge of each of said side parts, $W_1$ is a width of each of said side part outlet holes in a direction orthogonal to the outer circumferential edge of a corresponding one of said side parts, and $S_2$ is an opening area of each of said corner part outlet holes.

2. The air conditioner as recited in claim 1, wherein said opening area of each of said corner part outlet holes is less than an opening area of each of said side part outlet holes.

3. The air conditioner as recited in claim 1, wherein two of said side part outlet holes which are adjacent to each of said corner part outlet holes, are substantially mutually orthogonal to each other.

4. The air conditioner as recited in claim 3, wherein each of said corner part outlets has a circumferential edge part formed so that an air current blown out from each of said corner part outlets is blown out in a direction away from an air current blown out from each of said two of said side part outlets.

5. The air conditioner as recited in claim 3, wherein each of said corner part outlets has a guide flap configured to guide an air current from each of said corner part outlets, respectively, away from an air current blown out from each of said two of said side part outlets.

6. The air conditioner as recited in claim 2, wherein two of said side part outlet holes which are adjacent to each of said corner part outlet holes, are substantially mutually orthogonal to each other.

7. The air conditioner as recited in claim 6, wherein each of said corner part outlets has a circumferential edge part formed so that an air current blown out from each of said corner part outlets is blown out in a direction away from an air current blown out from each of said two of said side part outlets.

8. The air conditioner as recited in claim 6, wherein each of said corner part outlets has a guide flap configured to guide an air current from each of said corner part outlets, respectively, away from an air current blown out from each of said two of said side part outlets.

9. The air conditioner as recited in claim 1, wherein each of said corner part outlets has a circumferential edge part formed so that an air current blown out from each of said corner part outlets is blown out in a direction away from an air current blown out from each of said two of said side part outlets.

10. The air conditioner as recited in claim 1, wherein each of said corner part outlets has a guide flap configured to guide an air current from each of said corner part outlets, respectively, away from an air current blown out from each of said two of said side part outlets.

11. The air conditioner as recited in claim 1, further comprising linking pins arranged at horizontal ends of each of said plurality of side part outlets to support said horizontal flaps.

12. The air conditioner as recited in claim 11, further comprising a plurality of linking shafts that mutually joins said linking pins, each of said plurality of linking shafts is arranged to extend through one of said plurality of corner parts.

13. The air conditioner as recited in claim 12, further comprising a motor linked to one of said plurality of linking shafts, wherein said motor is arranged to oscillate synchronously said horizontal flaps.

14. The air conditioner as recited in claim 13, wherein said plurality of linking shafts are three in number.

15. The air conditioner as recited in claim 1, wherein each of said corner part outlets has a pair of circumferential edge parts formed so that each circumferential edge part is inclined relative to a circumferential edge part of the side part outlet adjacent thereto so an air current blown out from each of said corner part outlets is blown out in a direction away from an air current blown out from said side part outlets adjacent thereto.

16. The air conditioner as recited in claim 15, wherein each of said corner part outlets has a pair of circumferential edge parts connecting inner and outer edges thereof; and an inner end of each circumferential edge part of each corner part outlet is arranged outward of an inner edge of an adjacent one of the side part outlets as measured along the direction of $W_1$.

17. The air conditioner as recited in claim 1, wherein each of said corner part outlets has a pair of circumferential edge parts connecting inner and outer edges thereof; and an inner end of each circumferential edge part of each corner part outlet is arranged outward of an inner edge of an adjacent one of the side part outlets as measured along the direction of $W_1$.

* * * * *